US010145082B2

(12) United States Patent
Miyazaki et al.

(10) Patent No.: US 10,145,082 B2
(45) Date of Patent: Dec. 4, 2018

(54) WORK VEHICLE AND BACKHOE

(71) Applicant: Kubota Corporation, Osaka-shi (JP)

(72) Inventors: Eiji Miyazaki, Sakai (JP); Takahiro Yonekura, Sakai (JP); Masaki Abe, Sakai (JP)

(73) Assignee: Kubota Corporation, Osaka (JP)

( * ) Notice: Subject to any disclaimer, the term of this patent is extended or adjusted under 35 U.S.C. 154(b) by 15 days.

(21) Appl. No.: 15/347,170

(22) Filed: Nov. 9, 2016

(65) Prior Publication Data

US 2017/0159264 A1 Jun. 8, 2017

(30) Foreign Application Priority Data

Dec. 7, 2015 (JP) ..... 2015-238815

(51) Int. Cl.
*E02F 3/96* (2006.01)
*E02F 3/627* (2006.01)

(52) U.S. Cl.
CPC ..... *E02F 3/964* (2013.01); *E02F 3/627* (2013.01); *E02F 3/6273* (2013.01)

(58) Field of Classification Search
CPC ..... E02F 3/627; E02F 3/6273; E02F 3/964
See application file for complete search history.

(56) References Cited

U.S. PATENT DOCUMENTS

2003/0009920 A1* 1/2003 Aoki ..... E02F 3/627 37/468

FOREIGN PATENT DOCUMENTS

JP 2009257076 A 11/2009

* cited by examiner

*Primary Examiner* — Ronald P Jarrett
(74) *Attorney, Agent, or Firm* — The Webb Law Firm

(57) ABSTRACT

A work vehicle including an attachment mechanism for attaching a backhoe to a vehicle body. The attachment mechanism includes a pin provided in the vehicle body, an engaging body provided in the backhoe and engageable with the pin, and a locking body for fixing the engaging body to the pin under mutually engaged state. As the engaging body comes into engagement with the pin, the engaging body and the pin are fixed under the mutually engaged state.

7 Claims, 5 Drawing Sheets

WORK VEHICLE AND BACKHOE

CROSS-REFERENCE TO RELATED APPLICATION

This application claims priority to Japanese Patent Application No. 2015-238815 filed Dec. 7, 2015, the disclosure of which is hereby incorporated in its entirety by reference.

BACKGROUND OF THE INVENTION

Field of the Invention

The present invention relates to a backhoe attachable/detachable to/from a rear portion of a vehicle body and relates also to a work vehicle having such backhoe.

Description of the Related Art

As an example of such work vehicle as above, a work vehicle is known already as being disclosed in Patent Document 1 (Japanese Unexamined Patent Application Publication No. 2009-257076). The work vehicle disclosed in Patent Document 1 includes a backhoe attachable/detachable to/from a rear portion of a vehicle body. In this work vehicle disclosed in Patent Document 1, the backhoe is attached to the vehicle body by inserting a pin in a through hole provided in the backhoe and a through hole provided in the vehicle body.

SUMMARY OF THE INVENTION

Problem to be Solved by Invention

With the work vehicle disclosed in Patent Document 1, attaching of the backhoe to the vehicle body is troublesome as requiring the above-described operation.

In view of the above-described state of the art, there is a need for a backhoe that can be easily attached to or detached from the vehicle body as well as for a work vehicle having such backhoe.

Solution

According to a characterizing feature of the present invention, a work vehicle comprises:

a backhoe attachable/detachable to/from a rear portion of a vehicle body; and an attachment mechanism for attaching the backhoe to the vehicle body;

wherein the attachment mechanism includes an engaged member provided in the vehicle body, an engaging member provided in the backhoe and engageable with the engaged member, and a locking member for fixing the engaging member to the engaged member under mutually engaged state thereof, and the locking member is configured to fix the engaging member to the engaged member under the mutually engaged state when the engaging member comes into engagement with the engaged member.

With the above-described characterizing arrangement, the engaging member can be fixed under its state of being engaged with the engaged member by the locking member, simply by bringing the engaging member into engagement with the engaged member. With this, the backhoe can be easily attached to the vehicle body. Namely, the backhoe can be attached to or detached from the vehicle body easily, without using a pin, a bolt, etc.

Further, in the present invention, preferably:

the engaging member is switchable between an engaging position for engagement with the engaged member and a non-engaging position not engaged with the engaged member;

the locking member is switchable between a locking position for fixing the engaging member to the engaged member under the mutually engaged state and a releasing position for releasing the fixing;

a first urging member is provided for urging the engaging member to switch the engaging member to the non-engaging position; and the engaging member is switched to the non-engaging position by the first urging member in association with switchover of the locking member to the releasing position.

With the above-described characterizing arrangement, by switching the locking member to the releasing position, the engaging member can be speedily switched to the non-engaging position and also the engaging member can be stably maintained at the non-engaging position, by the first urging means.

Further, in the present invention, preferably:

there are provided a pair of upper and lower engaging members as the engaging member; and at least one of the pair of upper and lower engaging members has a shape to be disposed laterally of the first urging member when switched to the non-engaging position.

With the above-described characterizing arrangement, when the engaging member is switched to the non-engaging position, this engaging member is present laterally of the first urging member. With this, at the time of detachment/detachment of the backhoe, the first urging member is supported to the lateral portion of the engaging member. Therefore, wobbling of the first urging member can be suppressed, thus effectively preventing inadvertent detachment of the first urging member. In this, if the first urging member is supported to a stepped portion between the lateral portion of the upper engaging member and the lateral portion of the lower engaging member, this will tend to cause damage to the first urging member. For this reason, in order for the first urging member not to be supported to such stepped portion, preferably, both or one of the pair of upper and lower engaging members are/is disposed laterally of the first urging member. And, more preferably, in view of possibility of engagement error or the like in a used state, either one of the pair of upper and lower engaging members is disposed laterally of the first urging member.

Further, in the present invention, preferably:

a second urging member is provided for urging the locking member to switch the locking member to the locking position;

there is provided an inhibiting member that is switchable between an inhibiting state for inhibiting switchover of the locking member to the locking position and a permitting state for permitting the switchover of the locking member to the locking position; and the locking member is switched to the locking position by the second urging member in association with switchover of the inhibiting member to the permitting state and subsequent engagement of the engaging member with the engaged member.

With the above-described characterizing arrangement, when the inhibiting member is switched to the inhibiting state, there occurs no inadvertent switchover of the locking member to the locking position by the second urging member. Further, when the inhibiting member is switched to the permitting state to allow engagement of the engaging member with the engaged member, the engaging member will be fixed under the mutually engaged state with the engaged member. In the course of this, thanks to the second urging member, the locking member can be switched to the locking position speedily and can also be maintained at this locking position in a stable manner.

Further, in the present invention, preferably:

there are provided a pair of upper and lower engaging members as the engaging member; and between the pair of upper and lower engaging members, there is provided an engaging member positioning pin for fixing the engaging member at the non-engaged position.

With the above-described characterizing arrangement, as the engaging member is fixed at the non-engaging position by the engaging member positioning pin, there occurs no contact between the upper engaging member and the lower engaging member. With this, even if there exists a difference of operational range between the upper engaging member and the lower engaging member, the engagement with the engaged member can be effected in a stable manner, since non-engaging positions of the respective engaging members are determined accurately.

Further, in the present invention, preferably:

a locking member positioning pin is provided for fixing the locking member at the locking position.

With the above-described characterizing arrangement, as the locking member is fixed at the locking position by the locking member positioning pin, the engaging member can be firmly fixed under the engaged state engaged with the engaged member by the locking member.

Further, in the present invention, preferably:

the engaging member positioning pin and the locking member positioning pin comprise a single same member.

With the above-described characterizing arrangement, through the commonization of the members, cost reduction is made possible and space saving is made possible also.

Further, in the present invention, preferably:

the engaged member comprises a shaft member that extends along a vehicle body left-right direction;

a pair of upper and lower engaging members are provided as the engaging member for sandwiching the engaged member therebetween along a vertical direction; and the locking member fixes the engaging member under the engagement with the engaged member when the locking member is inserted between the pair of upper and lower engaging members.

With the above-described characterizing arrangement, as the engaging members come into engagement with the shaft member from the upper and lower sides thereof, the engaged state of the engaging members relative to the shaft member can be stable. Further, since the above arrangement requires provision of only one locking member for the pair of upper and lower engaging members, this arrangement is less costly than an arrangement of providing locking members, one for one engaging member and another for the other engaging member, separately.

According to a further aspect of the present invention, a backhoe attachable/detachable to/from a rear portion of a vehicle body, comprises:

an attachment mechanism for attaching the backhoe to the vehicle body;

wherein the attachment mechanism includes an engaging member engageable with an engaged member on the vehicle body side, and a locking member for fixing the engaging member to the engaged member under mutually engaged state thereof, and the locking member is configured to fix the engaging member to the engaged member under the mutually engaged state when the engaging member comes into engagement with the engaged member.

With the above-described characterizing arrangement, the engaging member can be fixed under its state of being engaged with the engaged member by the locking member, simply by bringing the engaging member into engagement with the engaged member. With this, the backhoe can be easily attached to the vehicle body. Namely, the backhoe can be attached to or detached from the vehicle body easily, without using a pin, a bolt, etc.

EMBODIMENT

Figure 1:
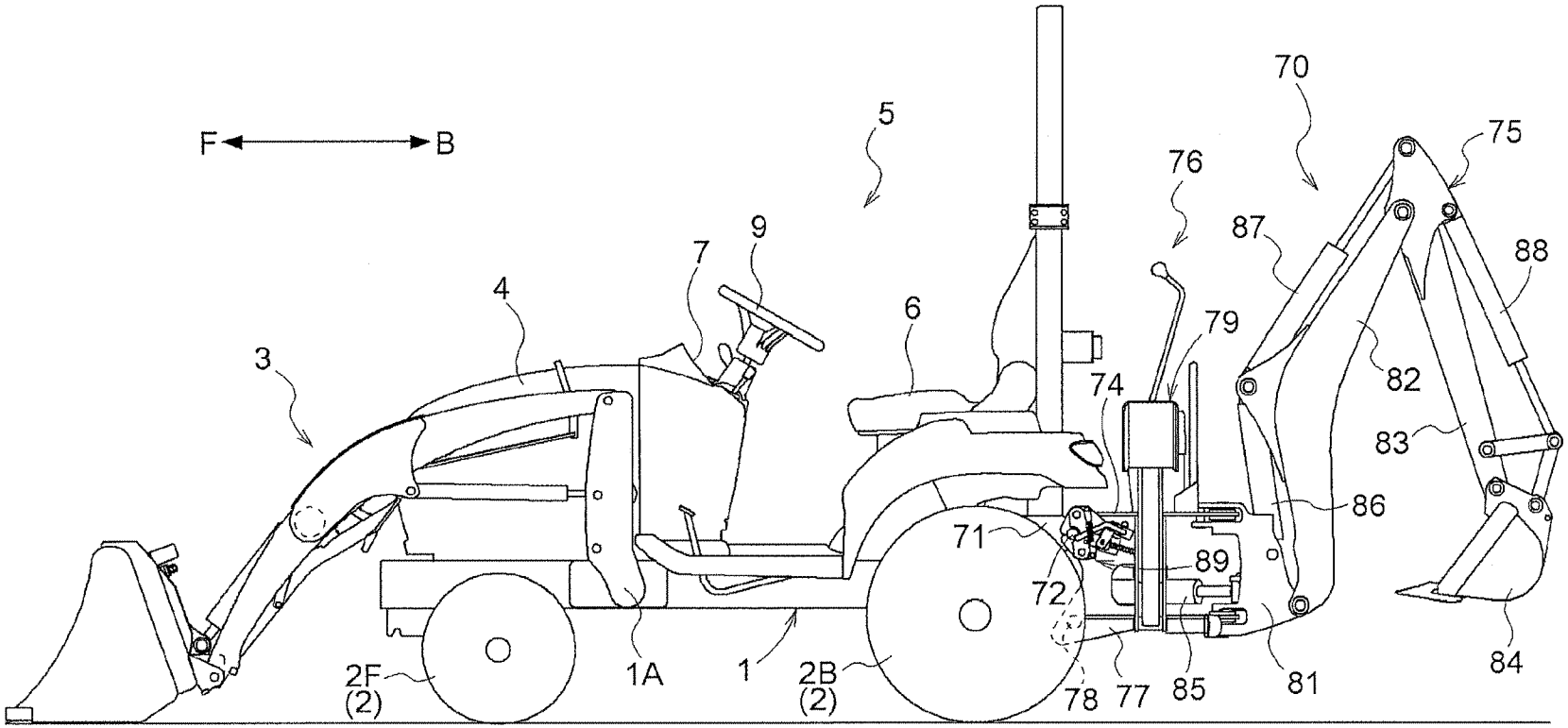
FIG. 1 is a left side view showing a tractor.
Figure 2:
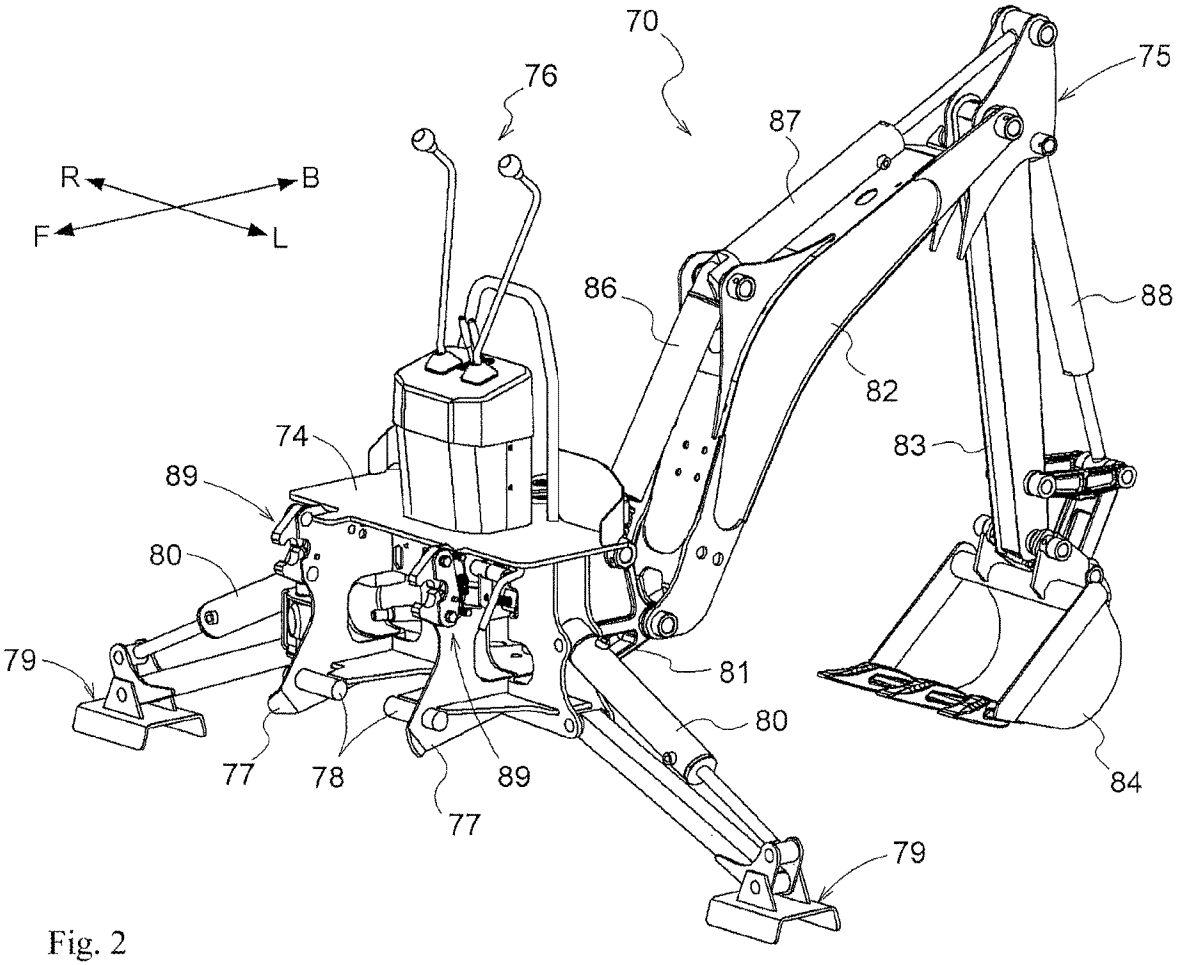
FIG. 2 is a perspective view showing a backhoe.

An embodiment of the present invention will be explained with reference to the accompanying drawings. Incidentally, in the following disclosure, a direction denoted with an arrow F in FIG. 1 and FIG. 2 represents "vehicle body front side", and a direction denoted with an arrow B therein represents "vehicle body rear (back) side", respectively. Also, a direction denoted with an arrow L in FIG. 2 represents "vehicle body left side" and a direction denoted with an arrow R therein represents "vehicle body right side", respectively.

[General Construction of Tractor]

FIG. 1 shows a tractor (corresponding to "a work vehicle" relating to the present invention) having a front loader 3 and a backhoe 70. This tractor further includes a vehicle body frame 1 and a wheel type traveling device 2 supporting the vehicle body frame 1. The traveling device 2 includes a pair of left and right front wheels 2F and a pair of left and right rear wheels 2B.

Forwardly of the vehicle body, the front loader 3 is provided. The front loader 3 is attachable to and detachable from the vehicle body. On the left side and right side of the vehicle body frame 1 respectively, there is provided an attaching frame 1A capable of attaching the front loader 3. At a front half portion of the vehicle body frame 1, there is provided a hood 4. Inside the hood 4, an engine (not shown) is accommodated.

Rearwardly of the vehicle body, the backhoe 70 is provided. This backhoe 70 is attachable to and detachable from a rear portion of the vehicle body. At a rear half portion of the vehicle body, there is provided a driving section 5 in which an operator is to ride. The driving section 5 includes a driver's seat 6, a front panel 7, and so on. In the front panel 7, a steering wheel 9 is provided. At a rear end portion of the vehicle body frame 1, there is provided a bracket 71 to which the backhoe 70 can be attached. The bracket 71 includes a pin 72 to be detailed later (corresponding to "an engaging portion" relating to the present invention) and a recess 73, for the sake of attachment of the backhoe 70 (see FIG. 3).

[Backhoe]

As shown in FIG. 1 and FIG. 2, the backhoe 70 includes a main frame 74, an implement body 75 supported to the main frame 74, and an operating section 76 for the operator to carry out an operation of the implement body 75, etc. At a front portion of the main frame 74, there are provided a pair of left and right side frames 77 to be attached to the bracket 71. From the lower side of the side frames 77, pins 78 project toward the vehicle body lateral inner side to be fitted into recesses 73 provided in the bracket 71 side.

To the left and right opposed extreme ends of the main frame 74, stabilizers 79 are supported respectively to be pivotable about pivot axes that extend along a vehicle body front/rear direction, between a ground contacting position and a non ground contacting position. Between each stabilizer 79 and the main frame 74, there is provided a hydraulic cylinder 80 for pivotally driving the stabilizer 79.

The implement body 75 includes a swing frame 81, a boom 82, an arm 83 and a bucket 84. The swing frame 81 is supported to a rear end portion of the main frame 74 to be pivotable about a pivot axis extending in the vertical direction. Between the swing frame 81 and the main frame 74, there is provided a hydraulic cylinder 85 for pivotally driving the swing frame 81. The boom 82 is supported to the swing frame 81 to be pivotable about a pivot axis extending in the vehicle body left-right direction. Between the boom 82 and the swing frame 81, there is provided a hydraulic cylinder 86 for pivotally driving the boom 82. The arm 83 is supported to a free end of the boom 82 to be pivotable about the pivot axis extending in the vehicle body left-right direction. Between the arm 83 and the boom 82, there is provided a hydraulic cylinder 87 for pivotally driving the arm 83. The bucket 84 is supported to a free end of the arm 83 to be pivotable about a pivot axis extending in the vehicle body left-right direction. Between the bucket 84 and the arm 83, there is provided a hydraulic cylinder 88 for pivotally driving the bucket 84.

[Attachment Mechanism for Backhoe]

Figure 3:
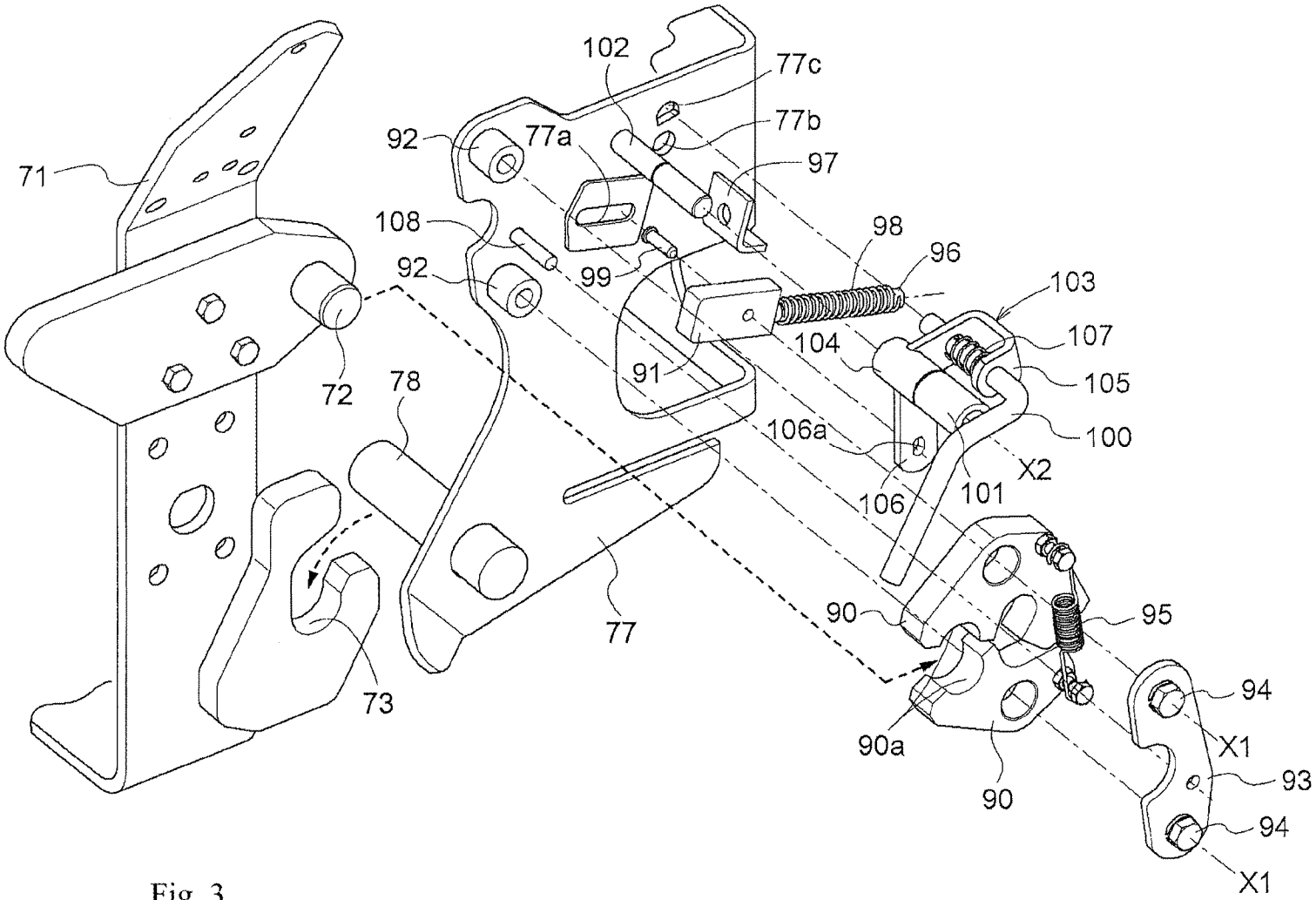
FIG. 3 is an exploded perspective view showing an attachment mechanism.
Figure 4:
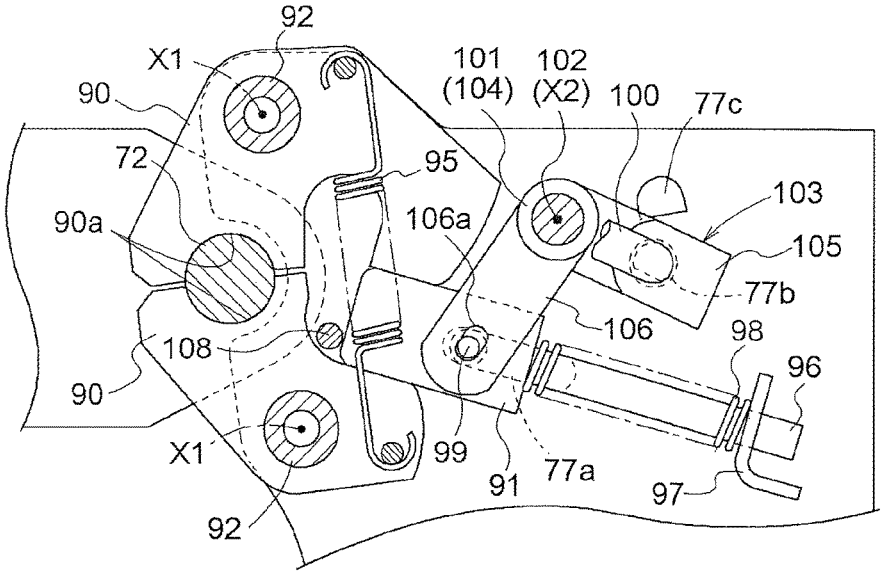
FIG. 4 is a left side view in section showing the attachment mechanism when engaging bodies are engaged with a pin.

As shown in FIG. 3 and FIG. 4, this tractor includes a pair of left and right attachment mechanisms 89 for attaching the backhoe 70 to the vehicle body. Each attachment mechanism 89 includes a pin 72 provided in the bracket 71, a pair of upper and lower engaging bodies 90 (corresponding to "an engaging member" relating to the present invention) engageable with a pin 72, and a locking body 91 (corresponding to "a locking member" relating to the present invention) for fixing the engaging bodies 90 as being engaged with the pin 72.

[Pin]

The pin 72 is a shaft member that extends in the vehicle body left-right direction. This pin 72 protrudes from an upper portion of the bracket 71 to the vehicle body lateral outer side.

[Engaging Bodies]

The engaging bodies 90 are switchable between an engaging position (see FIG. 4) for engagement with the pin 72 and a non-engaging position (see FIG. 5) not engaged with the pin 72. The engaging bodies 90 are configured to sandwich the pin 72 therebetween along the vertical direction. The engaging bodies 90 are supported to boss portions 92 protruding from the side frame 77 to the vehicle body lateral outer side to be pivotable about a pivot axis X1 that extends along the vehicle body left-right direction. Each engaging body 90 defines an arc-shaped recess 90*a* that extends along the outer circumference shape of the pin 72.

Between the pair of upper and lower boss portions 92, there is provided a retaining plate 93 for retaining the engaging bodies 90 so that these engaging bodies 90 will not remove from the boss portion 92. The retaining plate 93 is fixed to the boss portion 92 by a bolt 94. Between the pair of upper and lower engaging bodies 90, there is provided a first spring 95 (corresponding to "a first urging member" relating to the present invention) for urging the engaging bodies 90 to switch over them to the non-engaging position. The first spring 95 is provided on the side opposite the recess 90*a* relative to the pivot axis X1 in the engaging bodies 90.

[Locking Body]

The locking body 91 is switchable between a locking position (see FIG. 4) for fixing the engaging bodies 90 under engagement with the pin 72 and a releasing position (see FIG. 5) for releasing this fixing. The locking body 91 is fixed to a leading end of a rod 96. This rod 96 is slidably supported to a stay 97 on the side frame 77 side. On this rod 96 and between the locking body 91 and the stay 97, there is provided a second spring 98 (corresponding to "a second urging member" relating to the present invention) for urging the locking body 91 to switch this locking body 91 to the locking position. The locking body 91 includes a guide pin 99 that extends through the locking body 91 in the vehicle body left-right direction. The side frame 77 defines a guide groove 77*a* for guiding the guide pin 99.

[Locking Lever]

There is provided a locking lever 100 (corresponding to "an inhibiting member" relating to the present invention) switchable between an inhibiting state (see FIG. 5) for inhibiting switchover of the locking body 91 to the locking position and a permitting state (see FIG. 6) for permitting the switchover of the locking body 91 to the locking position. The locking lever 100 is supported via a boss portion 101 to a support shaft 102 on the side frame 77 side to be pivotable about the pivot axis X2 extending in the vehicle body left-right direction and also slidable along the direction of the pivot axis X2. The side frame 77 defines a locking position positioning hole 77*b* for fixing the locking lever 100 at a locking operational position corresponding to the locking position of the locking body 91 and a releasing position positioning hole 77*c* for fixing the locking lever 100 at a releasing operational position corresponding to the releasing position of the locking body 91.

[Link]

Between the locking lever 100 and the guide pin 99, there is provided a link 103 for operably linking the locking lever 100 with the locking body 91. The link 103 includes a boss portion 104 that is supported to the support shaft 102 to be pivotable about the pivot axis X2, a first arm portion 105 that is connected to the locking lever 100 and a second arm portion 106 that is connected to the guide pin 99. The first arm portion 105 slidably supports the locking lever 100 so that the locking lever 100 can slide along the pivot axis X2 direction. Between the first arm portion 105 and the locking lever 100, there is provided a spring 107 configured to urge the locking lever 100 for sliding this lever 100 toward the side frame 77 side. At a free end of the second arm portion 106, there is formed an elongate hole 106*a* in which the guide pin 99 is to be inserted.

[Attachment of Backhoe]

Figure 5:
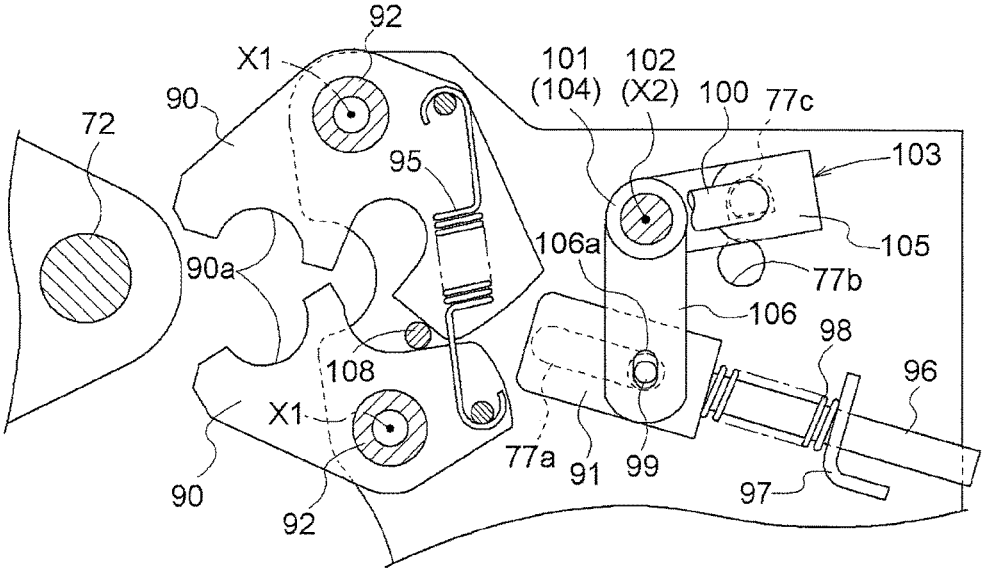
FIG. 5 is a left side view in section showing the attachment mechanism when a locking lever is switched to an inhibiting state.

Under the state illustrated in FIG. 5, as the locking lever 100 is inserted in the releasing position positioning hole 77*c*, this locking lever 100 is fixed at the releasing operational position by the releasing position positioning hole 77*c* and switched to the inhibiting state for inhibiting switchover of the locking body 91 to the locking position. And, as the engaging bodies 90 are pivoted to the non-engaging position side by the first spring 95 to come into contact with a positioning pin 108 (corresponding to "an engaging member positioning pin", "a locking member positioning pin" relating to the present invention) on the side frame 77 side, thus being fixed at the non-engaging position, hence, switched to the non-engaging position.

Figure 6:
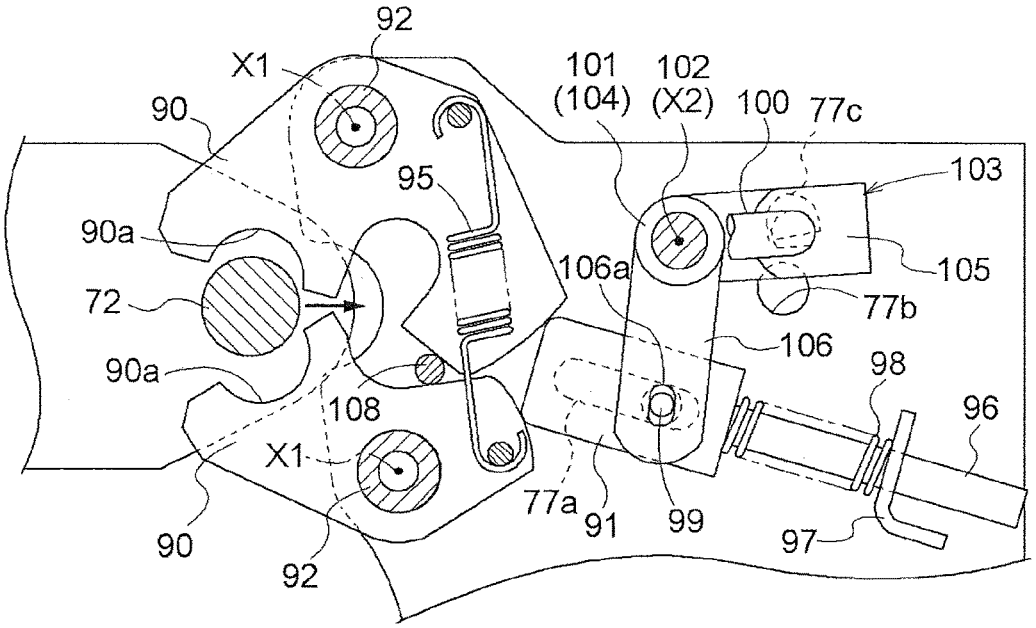
FIG. 6 is a left side view in section showing the attachment mechanism when the locking lever is switched to a permitting state.

Firstly, in order to attach the backhoe 70 to the vehicle body, the locking lever 100 will be pulled out toward the front side (vehicle body lateral outer side) from the releasing position positioning hole 77*c*, against the urging force of the spring 107. Namely, the locking lever 100 will be switched over to the permitting state for permitting switchover of the locking body 91 to the locking position. Then, as illustrated in FIG. 6, the locking body 91 will be caused to slide by the second spring 98 toward the locking position side to the position in contact with the engaging bodies 90, and also in operable linkage with the locking body 91 by the link 103, the locking lever 100 will be pivoted toward the locking position positioning hole 77*b* side about the pivot axis X2.

Then, with the pin 78 on the side frame 77 side being fitted in the recess 73 on the bracket 11 side, the backhoe 70 will be attached to the vehicle body so that the pin 72 may come into contact with the recesses 90*a* of the engaging bodies 90. With this, as illustrated in FIG. 4, the engaging bodies 90 will be pivoted toward the engaging position side about the pivot axis X1 against the urging force of the first spring 95, so that the upper engaging body 90 comes into engagement with the pin 72 from the upper side thereof and the lower engaging body 90 comes into engagement with the pin 72 from the lower side thereof, respectively. In association with this, the locking body 91 will be caused to further slide toward the locking position side by the second spring 98 such that this locking body 91 may be inserted between the pair of upper and lower engaging bodies 90 And, as the locking body 91 comes into contact with the positioning pin 108 on the side frame 77 side, the locking body 91 will be fixed at the locking position. In this way, the locking body 91 provides fixing with the engaging bodies 90 engaged with the pin 72. In the course of this, if the recess 73 and the pin 72 are approximately perpendicular relative to the floor surface, the attachment will be easier, so that operational efficiency can be improved. Further, in the instant embodiment, the locking body 91 and the engaging bodies 90 are in contact with each other via one face (not in contact in two or more faces).

Further, as the locking lever 100 is operably linked with the locking body 91 via the link 103, the locking lever 100 is further pivoted about the pivot axis X2 toward the locking position positioning hole 77*b* side. Then, when the locking lever 100 is positioned above the locking position positioning hole 77*b*, the lever 100 will be inserted into the locking position positioning hole 77*b* by the spring 107, and fixed at the locking operational position by this lock position positioning hole 77*b*.

Next, when the backhoe 70 is to be detached from the vehicle body, the locking lever 100 will be manually pivoted from the state illustrated in FIG. 4 to the state illustrated in FIG. 5. More particularly, the locking lever 100 will be pulled out toward the front side (vehicle body lateral outer side) from the locking position positioning hole 77*b* against the urging force of the spring 107 and then pivoted about the pivot axis X2 to the releasing position positioning hole 77*c*. With this, in its operative linkage with the locking lever 100 via the link 103, the locking body 91 will be switched over to the releasing position against the urging force of the second spring 98.

And, while the locking lever 100 is positioned above the releasing position positioning hole 77*c*, if the hand is released from the locking lever 100, the locking lever 100 will be inserted into the releasing position positioning hole 77*c* by the spring 107, thus being fixed at the releasing operational position by this releasing position positioning hole 77*c*. With this, the locking lever 100 will be switched to the inhibiting state for inhibiting switchover of the locking body 91 to the locking position. And, the engaging bodies 90 will be pivoted to the non-engaging position side by the spring 95 to come into contact with the positioning pin 108 on the side fame 77 side, thus being fixed to the non-engaging position and switched to the non-engaging position. With this, the backhoe 70 can now be detached from the vehicle body.

Other Embodiments (1) In the foregoing embodiment, in the attachment mechanism 89, there are provided a pair of upper and lower engaging bodies 90. Alternatively, only the upper engaging body 90 or only the lower engaging body 90 can be provided therein.

(2) In the foregoing embodiment, for the pair of upper and lower engaging bodies 90, one locking body 91 is provided. Instead, locking bodies 91 can be provided for the pair of upper and lower engaging bodies 90 respectively.

(3) For the upper engaging body 90 and the lower engaging body 90, the "engaging member positioning pin" can be provided respectively therefor. Further alternatively, the "engaging member positioning pin" and the "locking member positioning pin" can be separate members.

(4) In the foregoing embodiment, the tractor includes the front loader 3. But, the front loader 3 can be omitted.

(5) The present invention is applicable not only to a work vehicle having no cabin, but also to a work vehicle having a cabin.

The invention claimed is:

1. A work vehicle comprising:

a backhoe attachable/detachable to/from a rear portion of a vehicle body; and an attachment mechanism for attaching the backhoe to the vehicle body;

wherein the attachment mechanism includes an engaged member provided in the vehicle body, an engaging member provided in the backhoe and engageable with the engaged member, and a locking member for fixing the engaging member to the engaged member under a mutually engaged state thereof; and the locking member is configured to fix the engaging member to the engaged member under the mutually engaged state when the engaging member comes into engagement with the engaged member;

wherein the engaging member is switchable between an engaging position for engagement with the engaged member and a non-engaging position not engaged with the engaged member;

the locking member is switchable between a locking position for fixing the engaging member to the engaged member under the mutually engaged state and a releasing position for releasing the engaging member from the engaged member;

a first urging member is provided for urging the engaging member to switch the engaging member to the non-engaging position; and the engaging member is switched to the non-engaging position by the first urging member in association with switchover of the locking member to the releasing position;

wherein a second urging member is provided for urging the locking member to switch the locking member to the locking position;

there is provided an inhibiting member that is switchable between an inhibiting state for inhibiting switchover of the locking member to the locking position and a permitting state for permitting the switchover of the locking member to the locking position; and the locking member is switched to the locking position by the second urging member in association with switchover of the inhibiting member to the permitting state and subsequent engagement of the engaging member with the engaged member; and wherein the inhibiting member is supported by a support shaft on the side frame to be pivotable about a pivot axis extending in a vehicle body left-right direction and also slidable along a direction of the pivot axis;

the side frame defines a locking position positioning hole for fixing the inhibiting member at a locking operational position corresponding to the locking position of the locking member, and a releasing position positioning hole for fixing the inhibiting member at a releasing operational position corresponding to the releasing position of the locking member; and a third urging member is provided for urging the inhibiting member for sliding the inhibiting member toward the side frame.

2. The work vehicle according to claim 1, wherein:

there are provided a pair of upper and lower engaging members as the engaging member; and at least one of the pair of upper and lower engaging members has a shape is configured to be disposed laterally of the first urging member when switched to the non-engaging position.

3. The work vehicle according to claim 1, wherein:

there are provided a pair of upper and lower engaging members as the engaging member; and between the pair of upper and lower engaging members, there is provided an engaging member positioning pin for fixing the engaging member at the non-engaged position.

4. The work vehicle according to claim 3, wherein the engaging member positioning pin is also a locking member positioning pin provided for fixing the locking member at the locking position.

5. The work vehicle according to claim 4, wherein the engaging member positioning pin comprises a single same member.

6. The work vehicle according to claim 1, wherein:

the engaged member comprises a shaft member that extends along the vehicle body left-right direction;

a pair of upper and lower engaging members are provided as the engaging member for sandwiching the engaged member therebetween along a vertical direction; and the locking member fixes the engaging member under the engagement with the engaged member when the locking member is inserted between the pair of upper and lower engaging members.

7. A backhoe attachable/detachable to/from a rear portion of a vehicle body, comprising:

an attachment mechanism for attaching the backhoe to the vehicle body;

wherein the attachment mechanism includes an engaging member engageable with an engaged member on the vehicle body side, and a locking member for fixing the engaging member to the engaged member under a mutually engaged state thereof; and the locking member is configured to fix the engaging member to the engaged member under the mutually engaged state when the engaging member comes into engagement with the engaged member;

wherein the engaging member is switchable between an engaging position for engagement with the engaged member and a non-engaging position not engaged with the engaged member;

the locking member is switchable between a locking position for fixing the engaging member to the engaged member under the mutually engaged state and a releasing position for releasing the engaging member from the engaged member;

a first urging member is provided for urging the engaging member to switch the engaging member to the non-engaging position; and the engaging member is switched to the non-engaging position by the first urging member in association with switchover of the locking member to the releasing position;

wherein a second urging member is provided for urging the locking member to switch the locking member to the locking position;

there is provided an inhibiting member that is switchable between an inhibiting state for inhibiting switchover of the locking member to the locking position and a permitting state for permitting the switchover of the locking member to the locking position; and the locking member is switched to the locking position by the second urging member in association with switchover of the inhibiting member to the permitting state and subsequent engagement of the engaging member with the engaged member; and wherein the inhibiting member is supported by a support shaft on the side frame to be pivotable about a pivot axis extending in a vehicle body left-right direction and also slidable along a direction of the pivot axis;

the side frame defines a locking position positioning hole for fixing the inhibiting member at a locking operational position corresponding to the locking position of the locking member, and a releasing position positioning hole for fixing the inhibiting member at a releasing operational position corresponding to the releasing position of the locking member; and a third urging member is provided for urging the inhibiting member for sliding the inhibiting member toward the side frame.

* * * * *